US005970626A

United States Patent [19]

Schmidt et al.

[11] Patent Number: 5,970,626

[45] Date of Patent: Oct. 26, 1999

[54] DRYER FOR BROAD ARTICLES

[75] Inventors: Manfred Schmidt, Oberula-Olberode; Karl Maurer; Gerhard Lehn, both of Bad Hersfeld; Friedrich Bahner, Rotenburg/Fulda; Klaus Hentschel; Karl-Friedrich Lang, both of Bad Hersfeld, all of Germany

[73] Assignee: Babcock-Bsh GmbH, Bad Hersfeld, Germany

[21] Appl. No.: 09/008,008

[22] Filed: Jan. 16, 1998

[30] Foreign Application Priority Data

Jan. 17, 1997 [DE] Germany ..... 197 01 426

[51] Int. Cl.[6] ..... F26B 9/00

[52] U.S. Cl. ..... 34/631; 34/636; 34/638; 34/643

[58] Field of Search ..... 34/611, 614, 616, 34/620, 629, 631, 636, 638, 640, 641, 643, 650, 651, 659; 220/84, 85, 86, 95, 109, 117, 196.1

[56] References Cited

U.S. PATENT DOCUMENTS

| | | | |
|---|---|---|---|
| 3,529,357 | 9/1970 | Schuette et al. | 34/446 |
| 3,964,656 | 6/1976 | Hella . | |
| 4,428,128 | 1/1984 | Coulson . | |
| 4,498,250 | 2/1985 | Gageur et al. | 34/631 |
| 4,779,357 | 10/1988 | Troetscher | 34/638 |
| 4,782,600 | 11/1988 | Coulson . | |
| 4,785,985 | 11/1988 | Hürtgen | 34/643 |
| 4,787,547 | 11/1988 | Hella et al. | 34/643 X |
| 5,659,975 | 8/1997 | Bahner et al. | 34/636 X |
| 5,667,124 | 9/1997 | Bannenberg | 242/614.11 |

FOREIGN PATENT DOCUMENTS

| | | |
|---|---|---|
| 1 460 544 | 3/1969 | Germany . |
| 1 946 696 | 4/1970 | Germany . |
| 297 01 755 U1 | 5/1997 | Germany . |

*Primary Examiner*—Henry Bennett
*Assistant Examiner*—Steve Gravini
*Attorney, Agent, or Firm*—Herbert Dubno

[57] ABSTRACT

A drier for broad articles such as plasterboard has a conveyor in entraining the plasterboard along a drying path in a transport plane and the nozzle boxes for contacting the plasterboard with the drying air have their orifice surfaces inclined to the plasterboard to achieve uniformity of drying in terms of residual moisture content.

12 Claims, 5 Drawing Sheets

DRYER FOR BROAD ARTICLES

FIELD OF THE INVENTION

Our present invention relates to a drier for broad articles and particularly for webs, strip, boards and the like. Specifically the invention relates to a drier, especially a multistage drier, for plasterboard and to a drier in which drying air is blown onto articles from nozzle boxes which extend transversely of the travel path for the articles, e.g. the plasterboard.

BACKGROUND OF THE INVENTION

The term "plasterboard" is used herein to refer to a composite board made from plaster (gypsum) and cardboard and used largely in buildings as a wall board or the like. When plasterboard is made, a moist plaster composite is formed into board and must be dried. For this purpose a multistage drier of the forced-air type is commonly used. A drier for broad articles such as strip material or material in the form of boards, like plasterboard, can be constructed as described in DE-OS 19 46 696 which has previously recognized the problem of uniformly drying a board over the full width of the conveyer on which the boards are displaced in a transport path through the drier.

Basically that drier comprises a conveyor means which can include or be formed by a roller conveyor defining a transport plane on which the plasterboard is displaced through a plurality of drying stages. Nozzle boxes extend transversely of the drying path, are supplied with drying air from a blower arrangement, and train the jets of drying air against the plasterboard.

The nozzle boxes themselves are wedge-shaped so that the cross section of the nozzle box decreases from the inlet side of the nozzle box toward its opposite side. The nozzle box may have inlet openings at the wider end and may be closed at its narrow end. Distributed over the side of the nozzle box which is turned in the direction of the plasterboard or other article to be dried, is a plurality of nozzles. The taper or convergence of the nozzle box enables a more or less constant pressure to be maintained at the nozzle openings over the entire length of the nozzle box.

The wedge-shaped nozzle boxes are so arranged that the spacing of the nozzle box wall juxtaposed with the article is greatest where the nozzle box is narrowest and decreases toward the inlet side of the nozzle box or, stated otherwise, the spacing of this wall from the board passing through the drier increases in the direction of the tapered end from a smallest spacing close to the inlet side.

Because the jets of air flowing out of the nozzle box have to travel different distances to reach the surface of the board to be dried, the problem of maintaining a uniform velocity of contact of the various jets with the board in this earlier system is resolved by forming the nozzle as short tube segments whose lengths are greater, the further the nozzle is removed from the inlet side of the nozzle box. The outlet ends of these tubes can be at a constant distance from the board against which the streamlets of drying air is trained. Because the spacing between the outlets of the nozzles and the board to be dried is constant over the entire width of the transport path, there is a greater uniformity of drawing action over the width than in systems in which the mouth of the nozzle orifice is at a varying distance from the material treated. This earlier drier subdivides the drying action into zones and switches the inlet side of the nozzle boxes from one side to another side of the drier from zone to zone along the transport path.

The latter feature requires that the drive for the conveyor vary from side to side along the path as well and that complicates maintenance because of the need to have access on both sides. It also complicates the conveyor drive or the operation and reliability of the drier. In spite of all of these efforts, moreover, it has been found in practice that uniform drying across the width of the path cannot always be ensured.

The nonuniformity of the drying action is noticeable particularly in systems in which the drying is carried out at multiple levels, i.e. in a multilevel drier in which conveyors are spaced one above another and corresponding arrays of nozzle boxes are provided for each of the conveyors. Such driers are highly desirable because of their relatively compact construction.

With multilevel driers, especially where the cross section of individual nozzle boxes is small by comparison to the lengths of such nozzle boxes, there can be variations in the air velocity entering the nozzle boxes and within the nozzle boxes between the ends thereof so that there will also be variations in the velocities of the air jets emerging from the nozzle boxes. Furthermore, the air jets more remote from the inlet sides of the nozzle boxes tend to deviate more sharply from the vertical than the air jets closer to the inlet side. The air flowing out of the nozzle boxes tends to cause a greater cooling of the nozzle box and hence of the air reaching the boards to be dried at the side opposite the inlet side than toward the inlet side. This also tends to reduce the drying effect at the sides of the drier at which the narrow ends of the nozzle boxes are disposed. Finally it has been found that correction and adjustment of this earlier drier construction to provide uniformity in drying action is difficult or impossible.

OBJECTS OF THE INVENTION

It is, therefore, the principal object of the present invention to provide an improved drier, especially for plasterboard and especially a multilevel drier, whereby drawbacks of this earlier drier arrangement are avoided.

A more specific object of the invention is to provide a drier construction which provides for improved uniformity of drying across the width of the transport path.

Another object of the invention is to provide a drier which can facilitate correction in the event that there is deviation from drying uniformity and which can be constructed at low cost.

Still a further object of the invention is to provide a drier which is capable of drying plasterboards to a uniform residual moisture content and which, upon deviation thereof, can be readily adjusted or corrected.

SUMMARY OF THE INVENTION

These objects and others which will become more readily apparent hereinafter are attained, in accordance with the invention, by so inclining the nozzle wall of the nozzle box, relative to the transport plane that the nozzle orifices are of a greater distance from this plane at one side of the drier than at the other. More particularly, the drier for broad articles, especially web-shaped, band-shaped, strip-shaped and board-shaped articles, like plasterboard, can comprise:

- a housing;
- a conveyor in the housing for carrying a broad article to be dried along a generally horizontal path longitudinally through at least one drying stage in the housing;
- a plurality of nozzle boxes for the stage extending transversely of the path over a full width of the conveyor, the nozzle boxes being formed with inlet openings at a first end, being closed at an opposite end and being formed with nozzle openings trained on at least one side of the broad article between the ends as the broad article is displaced in a transport plane along the path;

means for blowing drying air through the inlet openings; and mounting and adjusting means for positioning the nozzle boxes with an inclination transversely to the path that the nozzle openings of each nozzle box are spaced to a greater extent from the transport plane on one side of the drier than on an opposite side thereof, and for shifting at least one of the ends of each nozzle box vertically.

The invention utilizes the fact that the heat transfer from an air stream impinging upon the plate to be dried is a function of the distance between the nozzle orifice and the board.

According to a feature of the invention the drier can be provided with a plurality of stages along the path and each of these stages can have a plurality of nozzle boxes. The nozzle boxes can be fixed in the housing at the inlet end and can be flexible to allow vertical displacement of the narrow end. The narrow end is preferably the only end of each nozzle box which is vertically displaceable. When the nozzle boxes are provided in a plurality of modules arrayed in a row, the nozzle boxes of different modules can be positioned with different inclinations to the transport plane.

Preferably the drier is a multilevel drier and the conveyor means can include a plurality conveyors one located above the other and in a vertical plane, a plurality of nozzle boxes can be provided with nozzles directed at the upper and undersides of the plasterboards displaced along the respective conveyors. The conveyors are preferably roller conveyors.

BRIEF DESCRIPTION OF THE DRAWING

The above and other objects, features, and advantages will become more readily apparent from the following description, reference being made to the accompanying drawing in which.

SPECIFIC DESCRIPTION

The drier is comprised, for example, of 30 or more modular units arranged in a row, i.e. horizontally, one next to another, along a transport path for the goods to be dried, in this case plasterboard. A modular unit is 2.0 m to 2.5 m in length in the transport direction, i.e. along the path, is 5.0 m to 6.0 m wide (i.e. has nozzle boxes and rollers of corresponding lengths transverse to the path) and has a roof 1 and side walls 2, 3.

Figure 1:
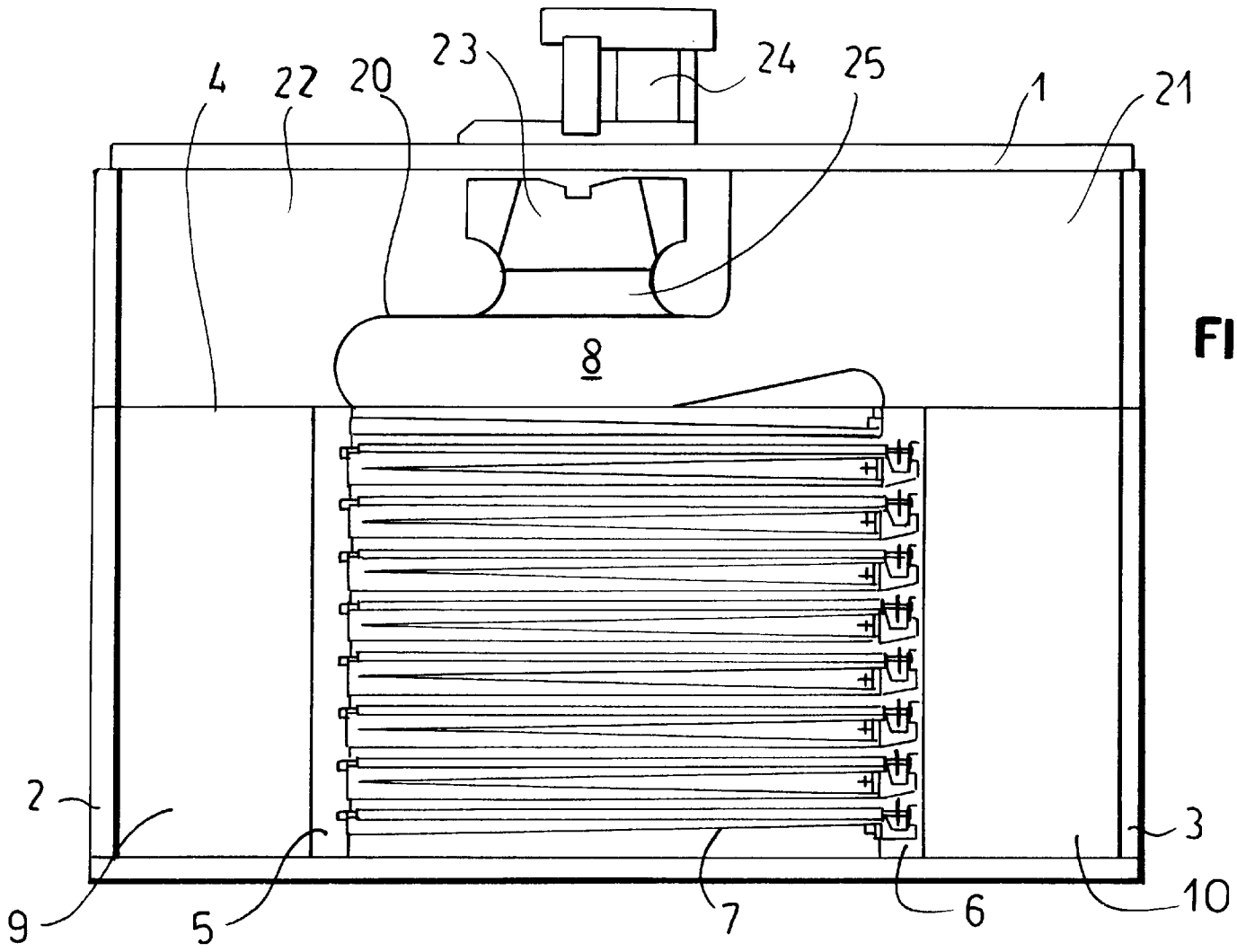
FIG. 1 is a transverse vertical section through a drier in which the transport direction is perpendicular to the plane of the paper.
Figure 2:
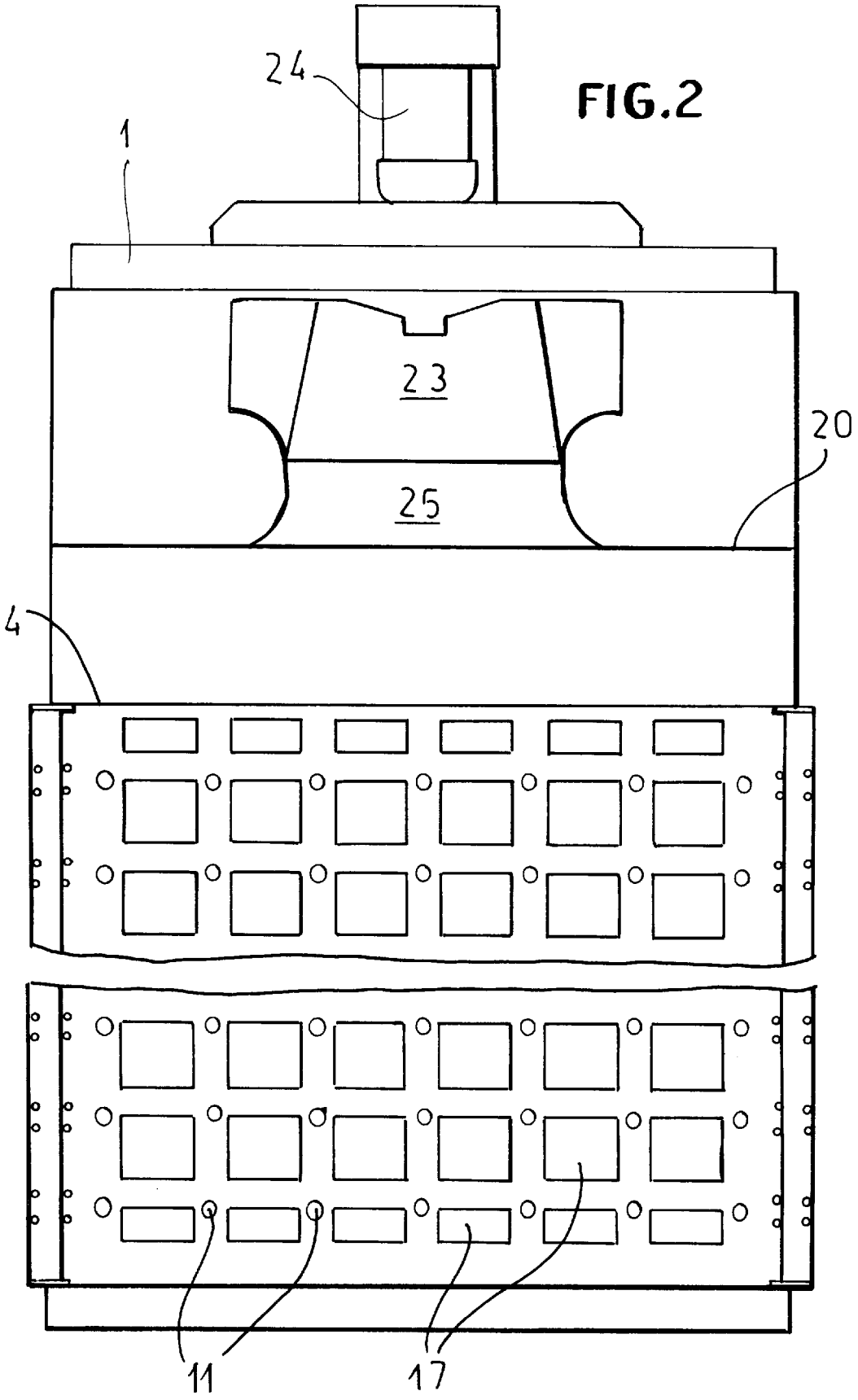
FIG. 2 is a longitudinal section showing one of the walls.

In FIG. 1, the travel path is perpendicular to the plane of the paper and the drier is seen in a vertical section or in elevation between two successive modules. Each module may be of a multiplicity of stages or levels, here eight levels so that, when the modules are aligned, they form eight conveyors spaced one above the other which can be driven to process eight successions of plasterboard simultaneously. While the nozzle boxes described below may train jets of drying air upon the upper surface only of each plasterboard article, preferably the nozzle boxes train jets of drying air upon both upper and lower surfaces of each plasterboard article.

Each module (FIG. 1), between an intermediate ceiling 4, a partition wall 5 and a grid-like support frame 6 has a central region 7 which is separated from an air circulation passage. The air circulation passage is formed by a horizontal duct 8 above the central region 7, a vertical lateral distributor or manifold duct 9 and a manifold collecting duct 10 which can be mirror-symmetrical to the duct 9 but on the opposite side. The width of the central region 7 can amount to about 50 to 65% of the total width and the height of the central region can amount to 60 to 80% of the total height.

Figure 4:
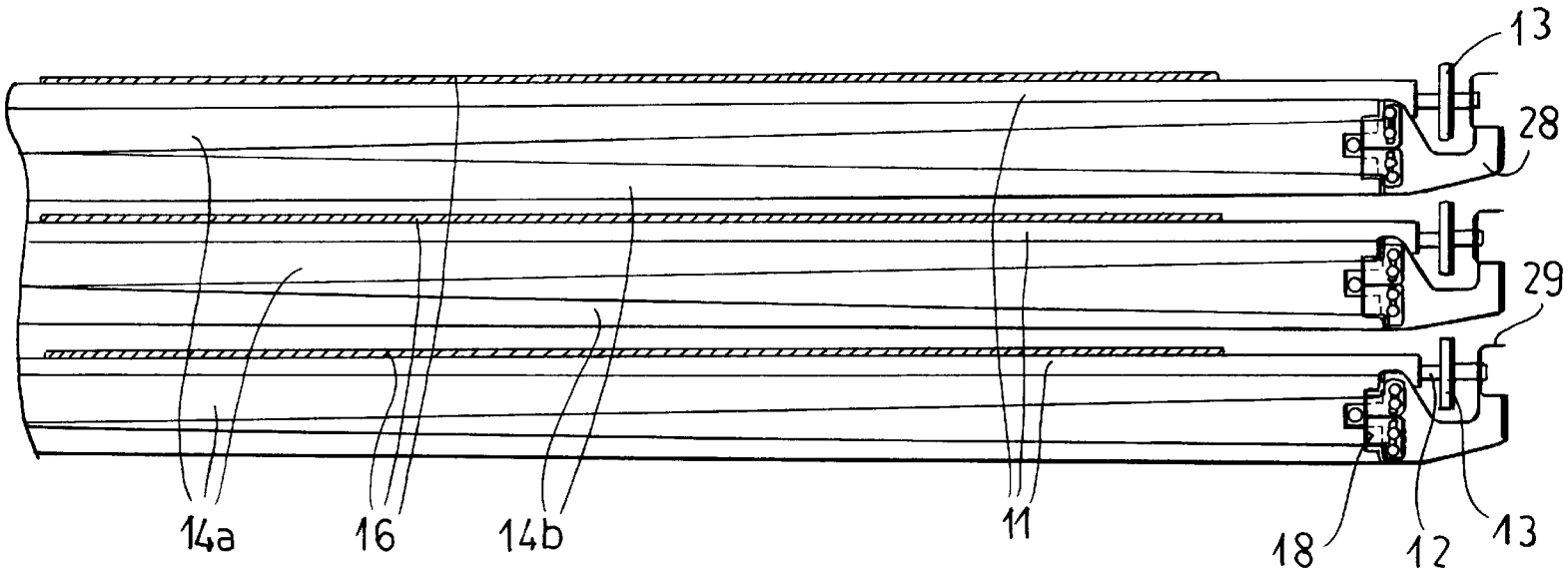
FIG. 4 is a section of a drier similar to FIG. 1 but to a larger scale.

In practice it has been found that eight to twelve levels are desirable and that the levels should be spaced apart by 250 to 350 mm equally over the height of the drier. Each of the conveyors (FIG. 4) is formed by rollers 11 which are journaled on one end in the partition 5 and at the other side in the support frame 6. At the end proximal to the support frame 6, each roller has a stub shaft 12 on which a sprocket is mounted. All of the rolls 11 can be driven by chains passing over or around the sprockets 13 and driven by a motor through another sprocket not shown. Each level thus forms a roller conveyor which extends over the entire length of the drier.

Figure 3:
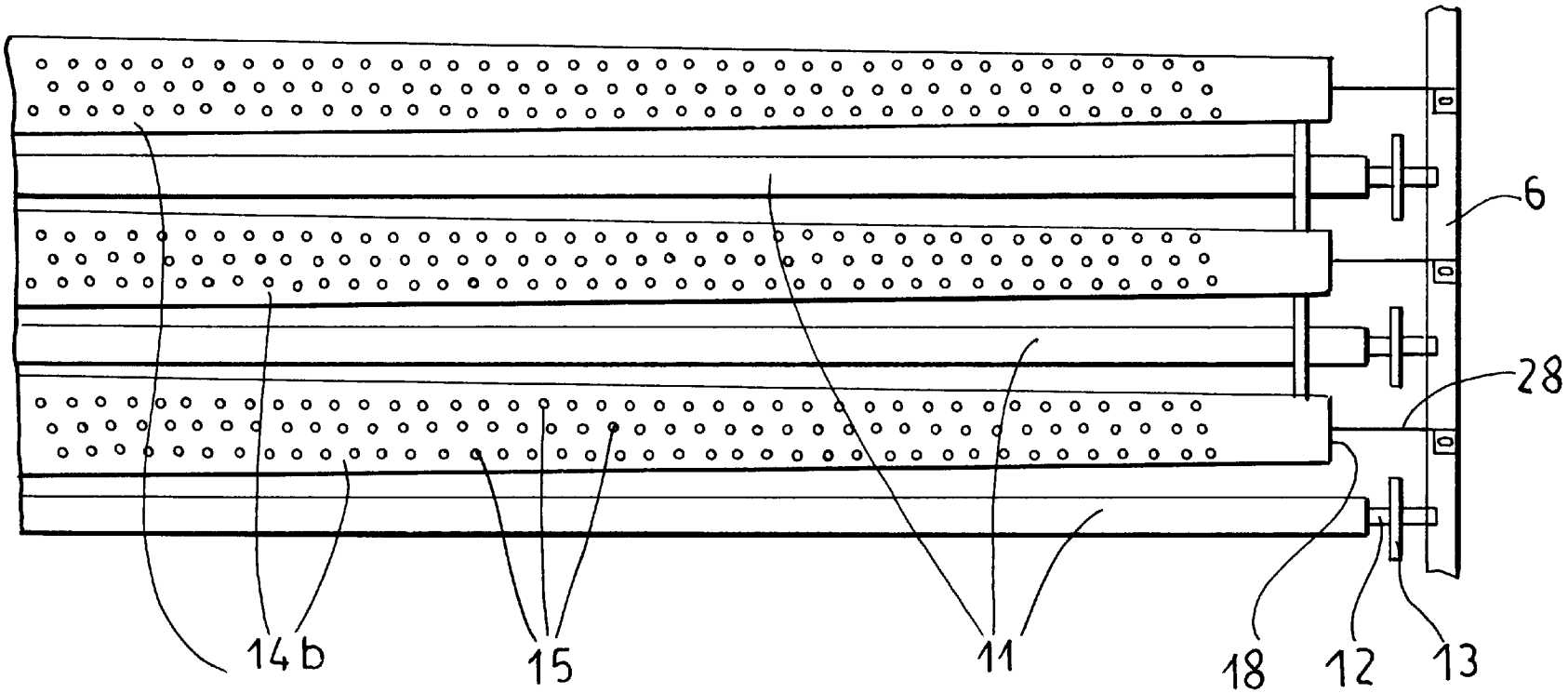
FIG. 3 is a plan view to a larger scale showing several rollers of the conveyor and a number of nozzle boxes.

Above and below the transport planes formed by the individual roller conveyors and on which the plasterboard is continuously advanced through the drier, finger-like nozzle boxes 14*a* and 14*b* are arranged, the nozzle boxes extending over the breadth of the roller conveyors. The wall of each nozzle box turned toward a transport plane of the nozzle boxes 14*a* and 14*b* (FIG. 4) is provided with nozzle orifices 15 (FIG. 3) from which drying air is trained on the plasterboard 16 traversing the conveyors.

One end of each nozzle box 14*a*, 14*b* is formed as an inlet opening 17 and the opposite end 18 is closed. The nozzle boxes 14*a* and 14*b* are wedge shaped, i.e. converge in the direction of the closed end so that the internal cross section monotonically decreases in the direction of the closed end 18.

Figure 4A:
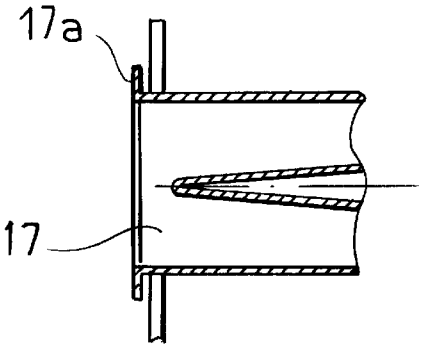
FIG. 4*a* is a detail of the region IVa of FIG. 4.

Between neighboring transport planes, respective upper nozzle boxes 14*a* and lower nozzle boxes 14*b* are provided in pairs with the paired nozzle boxes being connected at the inlet ends like legs of a garment so that each pair forms a double nozzle box fed through a common intake opening 17. The ends of the nozzle boxes formed with the intake openings 17 are fitted securely in rectangular cutouts of the partition 5. They are immovable and firmly fixed to the partition wall 5. Here they can be sealed in place by an angled collar 17*a* as shown in the detailed view of FIG. 4*a*. At the other end 18 each nozzle box rests upon a step 19*a* in a plate 19, hereinafter referred to as a holding plate (FIG. 5).

The horizontal duct 8 is subdivided by a stepped partition 20 into a suction chamber 21 and a pressure chamber 22. The suction chamber 21 communicates with the collecting manifold 8 while the pressure chamber 22 communicates with the distribution manifold 9. Midway in the horizontal duct 8 and indeed in the pressure chamber 22 separated by the partition

20, a housingless radial blower wheel 23 is provided which, upon rotation, sucks in air at one side. The drive shaft of this rotor passes through the roof 1 and is coupled with a drive 24 on the roof. The drive 24 can be connected to an electric motor. An intake funnel 25 of the rotor 23 (FIG. 1) corresponds to an opening in a horizontal region of the partition 20 so that the blower 23 has its suction side in connection with the suction chamber 21.

Figure 5:
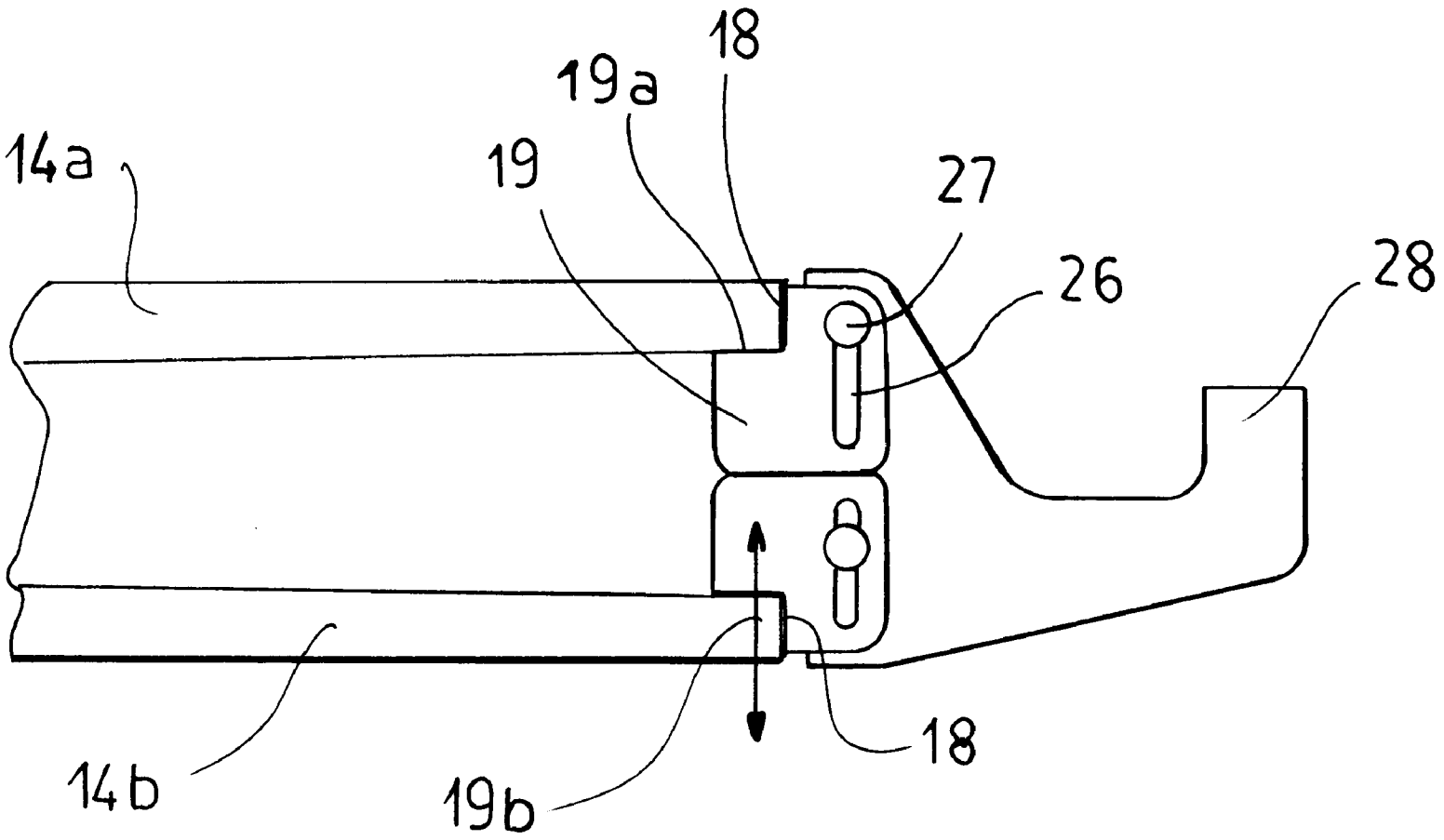
FIG. 5 is a detail showing the adjustment means for the vertical displacement of the narrow ends of the nozzle boxes.

The holding plates 19 are provided with longitudinal slots 26 (FIG. 5). A pair of screws 27 passing through the longitudinal slot 26 secures each holding plate 19 with one leg of a U-shaped fastening element 28. The other leg is fixed in a horizontal carrier 29 of the support frame 6. The slots 26 allow vertical displacement of the closed ends 18 of the nozzle box as represented by the double-headed arrow 19*b* in FIG. 5.

In the illustrated embodiment in which the nozzle openings 15 (FIG. 3) are configured as circular orifices, at the inlet side of the nozzle box the spacing between the orifices 15 and the plasterboard 16 is about four to five times the orifice diameter. At the closed end of the nozzle box, this distance diminishes to about 2.5 to four times the orifice diameter. With an orifice diameter of 1.0 to 1.5 cm, the maximum shift at the narrow end of each nozzle box can be approximately 30 cm. With nozzle boxes 14*a* and 14*b* having a length of about 3.0 m, this shift can be accommodated entirely by elastic deformability of the nozzle box.

The setting of the nozzle boxes 14*a* and 14*b* is effected upon the mounting of the nozzle box and assembly of the drier and in its initial operation. When all nozzle boxes 14*a* and 14*b* are so mounted that the nozzle orifices 15 have the same spacing from the plasterboard over the entire width of the path, it is found that the board at the inlet side of the nozzle box will be drier than at the closed end side of the nozzle box. The nozzle boxes can thus be set initially with a slight inclination to the respective transport planes based upon modelling and the use of a computer to approximate the positions for uniform drying. In this case, based upon a computer model, the nozzle orifices 15 can be closer to the plasterboard 16 at the closed end side of the nozzle box than at the intake side of the nozzle box. For example, in FIG. 4 the upper nozzle boxes 14*a* will have a slight slope or gradient to the left and the lower nozzle boxes 14*b* of the respective path will have a slight gradient or slope to the right. In driers which have a large number of modules arrayed in series one after the other, the inclinations of at least several modules are adjusted in groups. Furthermore it may not be necessary to incline all of the nozzle boxes as described in a long drier having a large number of nozzle boxes. It may suffice for example to incline only the nozzle boxes of the upstream half of the modules of the drier. If, after operation of the drier it is found that the residual moisture of the boards on one side is greater or less than the residual moisture of the other side, based upon the deviation from uniformity, a correction can be effected which adjusts the inclination of, say several nozzle boxes, by increasing the inclinations or reducing the inclinations thereof via adjustment of the respective supports 19 of members 26.

It has been found to be possible to correct such nonuniformity by adjustment of the nozzle boxes of only a single module in some instances. After correction, the nozzle boxes may be locked in place for operation and further adjustment may not be necessary at least for a given run of the drier.

We claim:

1. A drier for broad articles comprising:

a housing;

a conveyor in said housing for carrying a broad article to be dried along a generally horizontal path longitudinally through at least one drying stage in said housing;

a plurality of elongated nozzle boxes for said stage extending transversely of said path over a full width of said conveyor, said nozzle boxes being formed with inlet openings at a first end, being closed at an opposite end and being formed with nozzle openings trained on at least one side of said broad article between said ends as said broad article is displaced in a transport plane along said path;

means for blowing drying air through said inlet openings; and mounting and adjusting means for positioning said nozzle boxes with an inclination transversely to said path that said nozzle openings of each nozzle box are spaced to a greater extent from said transport plane on one side of the drier than on an opposite side thereof, and for shifting at least one of the ends of each nozzle box vertically, the nozzle boxes being provided in a plurality of modules arrayed in a row, the nozzle boxes of different modules being positioned with different inclinations to said transport plane and at least the nozzle boxes of one of the modules being closer to the transport plane at the end of the nozzle boxes than at an opposite end thereof.

2. The drier defined in claim 1 wherein said broad articles include web-shaped and board-shaped articles and said drier has a plurality of stages along said path, each of said stages being provided with a respective said plurality of said nozzle boxes.

3. The drier defined in claim 2 for plasterboard wherein only one end of each of said nozzle boxes is vertically displaceable.

4. A drier for broad articles comprising:

a housing;

a conveyor in said housing for carrying plasterboard to be dried along a generally horizontal path longitudinally through at least one drying stage in said housing;

a plurality of nozzle boxes for said stage extending transversely of said path over a full width of said conveyor, said nozzle boxes being formed with inlet openings at a first end, being closed at an opposite end and being formed with nozzle openings trained on at least one side of the plasterboard between said ends as said plasterboard is displaced in a transport plane along said path;

means for blowing drying air through said inlet openings; and mounting and adjusting means for positioning said nozzle boxes with an inclination transversely to said path that said nozzle openings of each nozzle box are spaced to a greater extent from said transport plane, said nozzle boxes being fixed immovably in said housing at said first ends thereof and being flexible to enable vertical shifting of said opposite ends of said nozzle boxes.

5. The drier defined in claim 4 wherein each of said nozzle boxes has a cross section diminishing from said first end to said opposite end of the respective nozzle box.

6. A drier for broad articles comprising:

a housing;

a conveyor in said housing for carrying a broad article to be dried along a generally horizontal path longitudinally through at least one drying stage in said housing;

a plurality of elongated nozzle boxes for said stare extending transversely of said path over a full width of said conveyor, said nozzle boxes being formed with inlet openings at a first end, being closed at an opposite end and being formed with nozzle openings trained on at least one side of said broad article between said ends as said broad article is displaced in a transport plane along said path;

means for blowing drying air through said inlet openings; and mounting and adjusting means for positioning said nozzle boxes with an inclination transversely to said path that said nozzle openings of each nozzle box are spaced to a greater extent from said transport plane on one side of the drier than on an opposite side thereof, and for shifting at least one of the ends of each nozzle box vertically, said nozzle boxes being fixed immovably in said housing at said first ends thereof and being flexible to enable vertical shifting of said opposite ends of said nozzle boxes.

7. A drier for broad articles comprising:

a housing;

a conveyor in said housing for carrying a broad article to be dried along a generally horizontal path longitudinally through at least one drying stage in said housing;

a plurality of elongated nozzle boxes for said stage extending transversely of said path over a full width of said conveyor, said nozzle boxes being formed with inlet openings at a first end, being closed at an opposite end and being formed with nozzle openings trained on at least one side of said broad article between said ends as said broad article is displaced in a transport plane along said path;

means for blowing drying air through said inlet openings; and mounting and adjusting means for positioning said nozzle boxes with an inclination transversely to said path that said nozzle openings of each nozzle box are spaced to a greater extent from said transport plane on one side of the drier than on an opposite side thereof, and for shifting at least one of the ends of each nozzle box vertically, each of said nozzle boxes having a cross section diminishing from said first end to said opposite end of the respective nozzle box.

8. The drier defined in claim 5 wherein each of said modules has a plurality of conveyor units disposed one above another in a multiplicity of tiers, each of said tiers being provided with a respective one of said nozzle boxes, said conveyor units forming respective conveyors extending a length of said drier.

9. The drier defined in claim 8 wherein said conveyor units are rollers of a driven roller conveyor.

10. The drier defined in claim 9 wherein a pair of said nozzle boxes are connected at respective inlet openings and communicate through a partition wall with a blower for blowing air into said nozzle boxes through said inlet openings.

11. The drier defined in claim 10 wherein said nozzle openings are circular orifices.

12. The drier defined in claim 10 wherein, at said first ends, said nozzle openings of said nozzle boxes are spaced from the plasterboard by 2.5 to 4 times an orifice diameter and said orifices are spaced from said plasterboard at said opposite ends of said nozzle boxes by about 2.5 to 4 times orifice diameter.

* * * * *